United States Patent [19]

Stagemeyer et al.

[11] 4,116,833

[45] Sep. 26, 1978

[54] METHOD AND APPARATUS FOR REMOVING CONTAMINANTS FROM BODIES OF WATER

[75] Inventors: Merlin D. Stagemeyer, Northbrook, Ill.; Seth Ford Allcorn, Columbia, Mo.

[73] Assignee: Oil Spill Recovery, Inc., Northbrook, Ill.

[21] Appl. No.: 779,638

[22] Filed: Mar. 21, 1977

[51] Int. Cl.[2] ..... B01D 21/24; E02B 15/04

[52] U.S. Cl. ..... 210/83; 210/242 S; 210/DIG. 25

[58] Field of Search ..... 61/1 F; 114/39, 267, 114/292; 210/83, 242 S, DIG. 25

[56] References Cited

U.S. PATENT DOCUMENTS

| | | | |
|---|---|---|---|
| 3,616,772 | 11/1971 | Popkin | 114/267 |
| 3,630,376 | 12/1971 | Price | 210/242 S |
| 3,638,430 | 2/1972 | Smith | 61/1 F |
| 3,648,463 | 3/1972 | Ayers | 61/1 F |
| 3,688,506 | 9/1972 | Marcocchio | 210/242 S X |
| 3,731,813 | 5/1973 | Tipton | 210/DIG. 25 |
| 3,779,385 | 12/1973 | Strohecker | 210/242 S X |
| 3,860,519 | 1/1975 | Weatherford | 210/242 S |
| 3,973,406 | 8/1976 | Casey | 61/1 F |

OTHER PUBLICATIONS

*Ocean Industry*, Jun. 1970, pp. 60 and 61.

*Primary Examiner*—Charles N. Hart
*Assistant Examiner*—Robert H. Spitzer
*Attorney, Agent, or Firm*—Fitch, Even, Tabin & Luedeka

[57] ABSTRACT

A method and apparatus for removing contaminants from the surface of water. An open-ended barricade is directed into and about a contaminant mass to channel the contaminant material to skimming apparatus which assists in collecting the material for recovery, storage and reuse. The process and apparatus is especially adaptable for use in naturally flowing bodies of water into which the apparatus is restrainably positioned to continuously and automatically remove the contaminant material. A scoop member, collection apparatus, and transporting circuit recovers the contaminant material for subsequent reuse while leaving the body of water free from contamination.

19 Claims, 16 Drawing Figures

METHOD AND APPARATUS FOR REMOVING CONTAMINANTS FROM BODIES OF WATER

BACKGROUND OF THE INVENTION

The present invention relates in general to pollution abatement apparatus and, in particular, to contaminant recovery systems for removing and/or recovering contaminant materials from the surface of a body of water.

Only recently has there been an overwhelming realization for the importance of protecting various elements of the earth's environment. In the area of water pollution, for example, society has only started to pay the price for years of careless, indiscriminate pollution of our oceans, rivers and lakes. Industrial wastes and refuse, public sanitation wastes, and mammoth oil spills are only some of the sources of pollution responsible for the virtual destruction of many of our bodies of water. One recent oil spill, for example, responsible for the dumping of millions of gallons of unrefined crude oil into the ocean, attested to the severity of our pollution problems in the form of marred beaches, wildlife destruction, and millions of dollars expended merely to trace the direction of the spill and determine its environmental impact. The overall damaging effects must be realized to include the virtual loss of extremely valuable and expensive resource material itself which could not and has not been recovered for reuse and/or reclamation.

It thus becomes apparent that there exists at present an overwhelming need for systems, apparatus, and the like which make possible the recovery of contaminant material from a myriad of bodies of water in order to prevent the destructive consequences now being encountered. These systems at the same time must be capable of recovering and reclaiming the often valuable resource causing the pollution itself.

Several relatively recent inventions have been directed to just these purposes. Some of these devices, for example, are directed primarily to the separating of oil and solids from water. While these are necessary elements for any attempt to recover the lost contaminant, for the most part, these inventions fail to solve the problem encountered with actually recovering the contaminant from the body of water before separation is attempted.

Other inventions have ranged from the utilization of flexible shields within a boat hull to act as a buffer in case of collision so as to protect an oil cargo; to vacuum inventions in which contaminant material is sucked into a vacuum hose suspended just below the surface of the water to fill a tank. With such a device the oil and water are sucked in together and, if given enough time, separate by gravity, at which time the water can be drained from the bottom of the tank and the oil reused.

In one invention, oil is removed from the surface of water by applying a mixture of wax and a volatile inflammable substance. The resulting mixture is ignited, the wax fuses into a solidified mass and is then picked up. Such an invention is embodied in U.S. Pat. No. 3,785,972. In U.S. Pat. No. 3,785,496, a carbohydrate fatty acid ester in powder, fibrous, or granular form, is applied to spilled oil on water. After picking the absorbent material back up, much of the oil is claimed to be recovered.

Several types of skimming devices have been utilized for the recovery and reclammation of contaminants such as oil. One type of oil skimming device, referred to as a drum type skimmer utilizes a rotating drum or cylinder covered with an oil absorbent material to absorb the oil from the oil and water mixture. The surfaces are generally not wetted by water but instead only by oil. The oil is squeezed or scraped off the surface of the drum by a knife blade or by rollers and then segregated from the water. It should be noted that the effectiveness of this type of skimmer is substantially small due to the substantial inefficiency utilized in skimming and withdrawing the oil from the saturated drum.

Another type of oil skimming device utilizes an oil absorbent surface on a continuous belt to absorb the oil from an oil and water mixture. In a manner equivalent to the drum type skimmer, this belt type skimmer carries the oil to the top of the belt mechanism where a blade or similar piece of equipment squeezes the oil from the belt before recycling. The belt is supported normally on two drums: one to submerge the belt in the oil and water mixture, and the other out of the mixture where the removal of the oil takes place. Besides encountering the inefficient removal problems discussed previously with the drum type oil skimmer, such a belt type oil skimming device is generally limited to calm waters or where oil films are of considerable thickness.

Another type of apparatus removes a surface layer of low density from a body of liquid of higher density. This Weir type of skimming device comprises a flexible pipe or pipes surrounded by a layer of buoyant material in an outer sheath so that the flexible pipes float on the surface of the body of liquid. A number of suction nozzles connected to the flexible pipes, a filter for separating the surface liquid from the liquid of the body and a method for discharging the separated water back into the main body of water are all incorporated into the apparatus. In operation, the pipeline is laid on the surface of the sea so that it surrounds the patch of oil which is to be removed. The suction nozzles dip into the surface layer and the contaminant and a certain amount of sea water are sucked into the piping and carried into a ship where it is forced to a filtering apparatus to separate the oil from the water.

The problems with existing contaminant recovery systems include their inability to accommodate all the variations that can occur with regards to (1) the type of contaminant being recovered, (2) the characteristics of the body of water from which the contaminant is being recovered, and (3) the temperatures of and reactions by the water and the contaminant to one another. For example, while some recovery devices work relatively well in calm waters, these devices have little, if any, effectiveness with turbulent or rolling seas which often complicate the recovery process. Further, all contaminants are not in the same material form. For example, three different types of petroleum contaminants, sweet, sour, and asphaltic, all provide different recovery problems for a skimming or recovery system. Asphaltic oil on the surface of substantially cold water, virtually hardens into an asphalt-like material which needs to be removed more like a solid than a liquid. Additionally, extremes in temperature of any body of water causes a contaminant located thereon to possess different and sometimes peculiar characteristics which cannot often be handled by the conventional skimming apparatus.

For the most part, the conventional skimming, vacuum, or other type of recovery devices require substantial machinery and investment, and are often cumbersome and difficult to deploy and control. Additives which break down the petroleum substance might offer a viable alternative to assist the environment but at the same time they destroy the resource that could be recovered. Various types of barrier restraints which merely surround the contaminant to keep it from spreading, again, protect the environment while doing little in the way of recovering a substantially valuable resource.

It is thus an object of the present invention to provide a system for effectively removing from the surface of a body of water petroleum and/or many other types of undesirable contaminants including vegetation or refuse, while at the same time recovering the contaminant in its original form for reuse or reprocessing.

It is further an object of the present invention to be flexible for use with many different types of contaminants in several types of bodies of water at varying temperatures.

Additionally, it is an object of the present invention to improve the recovery rate and efficiency with which the contaminant is recovered while at the same time being relatively easy to deploy and control.

Further, it is an object of the present invention to provide a system for effectively recovering the contaminant at a substantially reduced cost and with a minimum of manpower.

These and other objects of the invention will become apparent in light of the present specification.

SUMMARY OF THE INVENTION

The present invention comprises a method and apparatus for removing petroleum and other spilled contaminant materials from the surface of the body of water enabling the recovery of the contaminating material in its original form for reuse and/or reprocessing.

The method through which such contaminants are removed and/or recovered comprises:

a. positioning of an impervious open-ended main barricade around the periphery of the contaminant material.
b. channeling or funneling such contaminant material towards one or more contaminant collection areas,
c. skimming both the water and said contaminant material at these one or more collection areas,
d. separating the contaminant material from the water so as to isolate the contaminant material, and
e. directing the isolated contaminant material to more permanent retention means through which the material may be contained for the reuse and/or reprocessing.

The preferred embodiments of the process includes positioning the main barricade means of the contaminant material through independently maneuvering the outermost ends of the barricade by barricade deployment means. Such maneuvering substantially forms the barricade into a contaminant funneling means for converging the contaminant material towards the one or more collection areas. In situations which warrant it, the contaminant material may be preliminarily funneled into the main barricade means through the use of preliminary barricade and preliminary barricade deployment means so as minimize the deployment effort required with the maneuvering of the main barricade means.

Additionally, the preferred embodiment of the process includes channeling the contaminant material towards the one or more collection areas by moving the main barricade means and the collection means about and towards the periphery of the contaminant material so as to funnel the contaminant material towards and into the collection means.

Another way in which the channeling may be accomplished comprises restrainably positioning the barricade means transverse to the natural flow of the body of water, thereby using the natural flow of the water, as with rivers and streams, to converge the contaminant material towards and into the one or more collection areas without need for imparting movement to the barricade and collection means.

The system for removing and recovering the contaminant material from the surface of the body of water comprises an open ended apron channeling means maintained afloat in the body of water by apron buoys. This apron channeling means is impervious to the contaminant material and is restrainably attached to collection means so as to converge thereto. The collection means includes scoop means for skimming the contaminant material from the surface of the body of water as the contaminant material is directed into the collection means by the apron channeling means. Additionally, material transfer means are operably attached to the collection means for removing the contaminant material from the collection means, and system activation means are utilized for initiating movement between the system and the body of water to channel the contaminant material into the collection means so as to activate skimming.

In the preferred embodiment of the invention, the apron channeling means comprises an impenetrable upper apron member extending from below the bottom surface of the contaminant material to a position substantially above the upper surface of the contaminant material. The apron further includes a penetrable lower screen member extending downwardly from the apron member at a position beneath the lower surface of the contaminant material riding on the body of water. This lower screen member maintains the apron channeling means in a generally upright position and stabilizes the movement of the apron channeling means through the body of water. An alternative embodiment of apron channeling means comprises an integral apron member of plastic material which is impenetrable along an equivalent upper portion extending from below the bottom surface of the contaminant material to above the upper surface of the contaminant material. The integral apron member has a lower surface which is penetrable along a portion extending downwardly from below the bottom surface of the contaminant material for the equivalent purposes of maintaining the integral apron member in a generally upright position while stabilizing the movement of the apron through the body of water.

The previously mentioned apron buoys comprise a plurality of buoyant members attached to the apron channeling means along the outside periphery of the channeling means. Additionally, each of these buoys are arcuately shaped so as to minimize drag in the body of water and each is restrainably attached to the apron channeling means in a juxtaposed fashion by buoy attachment means.

The buoys, in the preferred embodiment, will additionally possess features for assisting in the deployment of the apron channeling means. For example, the buoyant members in one embodiment includes adjustable means for controlling the deployment of the apron channeling means about the contaminant material in the body of water. Further, keel means, sail means and adjustable rudder means are utilized on the buoy members to assist in the movement of the buoy members and for controlling the direction of movement of the buoy members and, in turn, the apron channeling means attached thereto.

The scoop means for skimming the contaminant material from the surface of the water comprises a substantially trapezoidal-shaped scoop member having flanged sides, which is pivotally attached to the collection means at the front of the collection means. The face of the scoop member is closely juxtaposed to the converging ends of the channeling means to effectively skim all contaminant material converging towards the collection means.

In the preferred embodiment, the scoop means further includes means for adjustment which in one embodiment comprises a substantially buoyant scoop roller means positioned beneath the scoop member, which is adjustable in a longitudinal direction beneath the scoop member to provide for variations in skimming angle and depth immersion of the scoop member relative to the longitudinal positioning of the scoop roller means. In yet another embodiment, the means for adjustment of the scoop comprise substantially buoyant scoop pontoon means positioned beneath the scoop member which is equivalently adjustable in a longitudinal direction to vary the skim angle and depth immersion of the scoop member relative to its adjustable position.

The apron channeling means preferably comprises a plurality of apron channeling segments which are pivotally attached to one another respectively so as to thereby facilitate the maintenance of a position, for the channeling means, on the surface of the body of water. Thus, if the body of water is substantially rolling or turbulent, the plurality of these pivotable shorter segments making up the apron channeling means will enable a substantial portion of the apron to maintain its appropriate surface position relative to the contaminant material on the surface of the body of water.

For the system to accomplish the function of channeling the body of water and its contaminant material toward the collection means, it is necessary that movement be imparted between the body of water and the system. Such movement is imparted through the previously mentioned system activation means in one of several ways. In the first embodiment, the system activation means comprises water towing means positioned at the open ends of the apron channeling means. The system activation means imparts flow to the body of water relative to the collection means while the apron channeling means is directed into and about the contaminant material to channel the contaminant material towards and into the collection means. In another embodiment, the system activation means comprises the natural flow movement of the body of water itself, at which time the system is restrainably positioned relative to the body of water. The natural flow of the body of water relative to the affixed system channels and directs the contaminant material into the collection means. In yet a third embodiment, the system activation means comprises integrated propellant means capable of pushing the system through the body of water so as to create flow between the system and the body of water to equivalently direct the contaminant material towards and into the collection means.

DETAILED DESCRIPTION OF THE DRAWINGS

Figure 1:
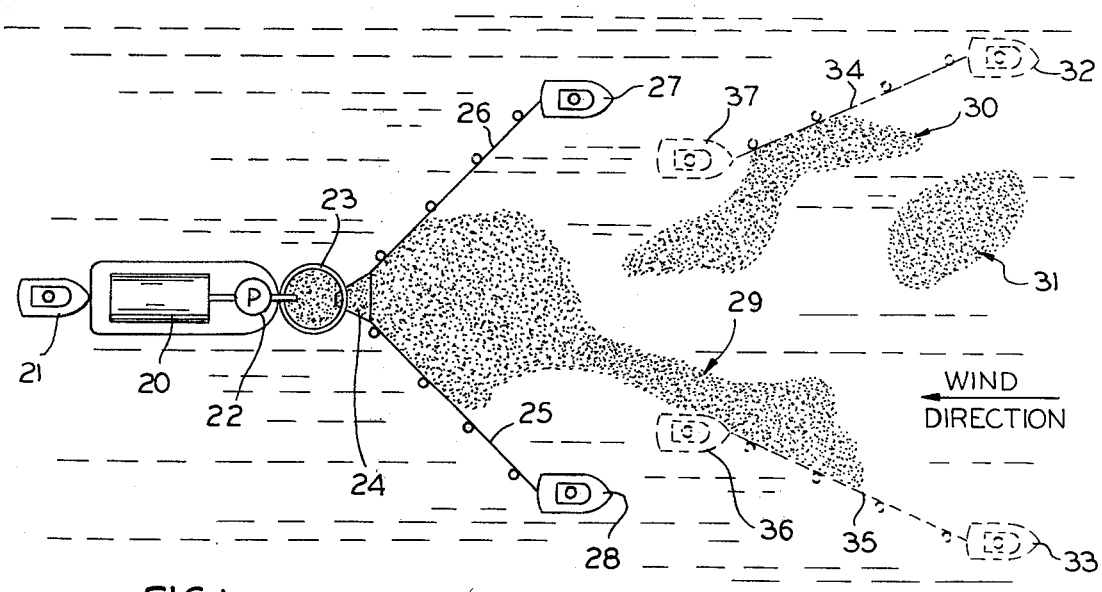
FIG. 1 of the drawings is a top schematic view of the system in operation as it is activated toward movement through towing means.

While this invention is susceptible of embodiments in many different forms, there is shown in the drawings, and will herein be described in detail, several specific embodiments with the understanding that the present disclosure is to be considered as an exemplification of the principles of the invention, and is not intended to limit the invention to the embodiments illustrated.

In FIG. 1 of the invention, the overall system is shown being activated to remove and recover contaminant material, such as materials 29, 30 and 31 from a body of water. Towboats 27 and 28 are shown directing apron channeling means 26 and 25 around contaminant material 29. The movement into and about contaminant material 29 funnels or channels the contaminant material on the surface of the water into scoop means 24 and subsequently into collection means 23. Transport means 22 are shown operably connected to collection means 23 for transferring the contaminant material to permanent storage means 20, propelled by towboat 21 at the same velocity as towboats 27 and 28. Additionally, separate apron channeling means may be used to preliminarily funnel the contaminant material 31 into channeling apron 26 and 25. For example, towboats 32 and 37 are shown funneling contaminant material 30 by apron channeling means 34 in an equivalent manner to the way in which towboats 33 and 36 maneuver channeling means 35 about contaminant material 29.

Figure 2:
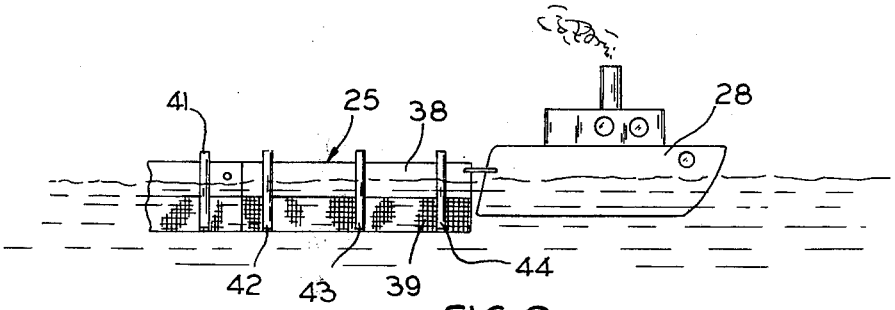
FIG. 2 is a side elevational view of a portion of the system shown in FIG. 1-1, illustrating, particularly, the relationship of the towing means to the apron channeling means.

In FIG. 2, towboat 28 is shown towing channeling apron 25 having upper contaminant impervious portion 38 and lower screen portion 39. Buoys 41 through 44 attached to apron channeling means 25, maintain the apron channeling means afloat on the surface of the body of water about the contaminant material.

Figure 3:
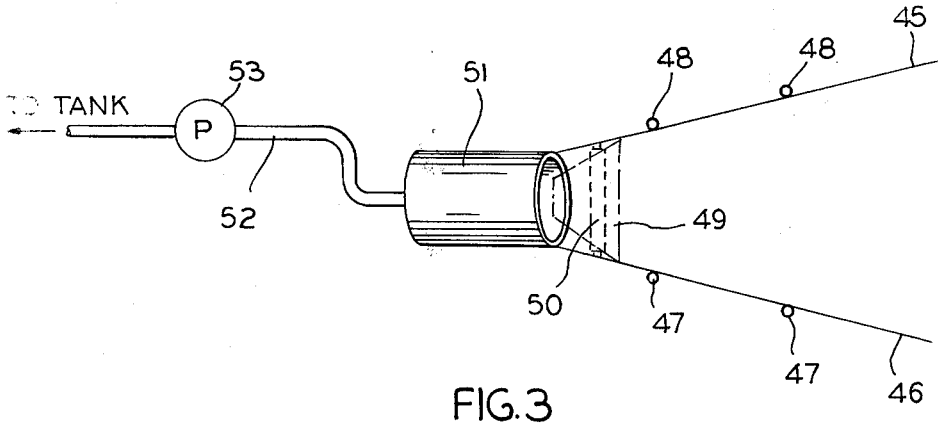
FIG. 3 is a top perspective view of one embodiment of collection means.

One embodiment of collection means 51 is shown in FIG. 3 which also illustrates the positioning of scoop 49 and scoop adjustment roller 50, together with the converging ends of the apron channeling means 45 and 46 maintained afloat by buoys 47 and 48. Material transport means 52 remove the skimmed contaminant material and water from collection means 51 through the utilization of pump 53 to more permanent storage means.

Figure 4:
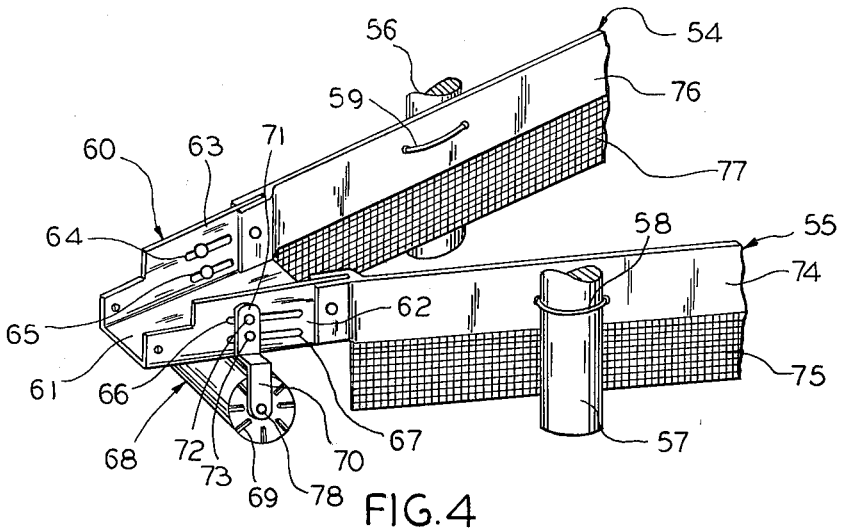
FIG. 4 is a side perspective view of the adjustable scoop means at the point of convergence of the apron channeling means.

A detailed view of the scoop means and attached portions of apron channeling means are shown in FIG. 4 in which scoop means 61 is pivotably attached to apron channeling means 54 and 55. Scoop adjustment roller 68 is shown in position below scoop 61 and which is attached by bracket 70 to the slotted orifices 64, 65, 66 and 67 in the scoop means to enable longitudinal positioning of the substantially buoyant roller 68 underneath scoop means 61. In the preferred embodiment of the invention, the roller utilizes fins, such as fins 69 on the outer ends of the roller to induce rotary motion to the roller as it is dragged in the body of water when system activation and movement is initiated. The portion of bracket 70 directly attached to scoop 61 is identified by reference numeral 71 and, as shown, portion 71 has apertures fabricated thereinto for the further purpose of securing the roller at a desired position along scoop 61 to allow for the adjustment of skimming angle and immersion depth of the front of the scoop. Additionally shown in FIG. 4 are apron channeling means 54 and 55 with upper portions 74 and 76, and lower screen portions 75 and 77 maintained afloat by buoys 56 and 57 which are attached to apron channeling means 54 and 55 respectively through apron channeling attachment means 59 and 58.

Figure 5:
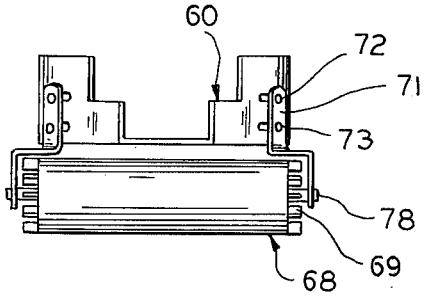
FIG. 5 is a front elevational view of the adjustable scoop means of FIG. 4.
Figure 6:
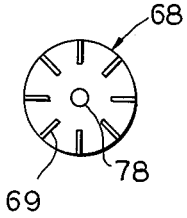
FIG. 6 is a side elevational view of the adjustable scoop roller means.
Figure 7:
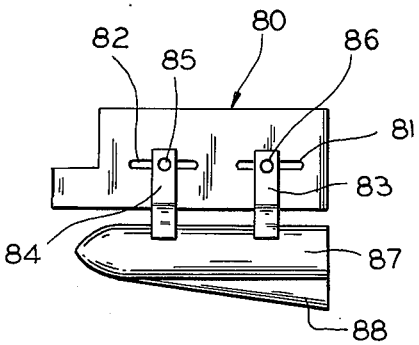
FIG. 7 is a side elevational view of the adjustable scoop pontoon means.
Figure 8:
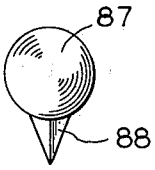
FIG. 8 is a front elevational view of one of the pontoons of the device shown in FIG. 7.

The scoop and adjustment roller assembly is shown in FIG. 5 in which scoop 60 has attached thereto adjustment roller 68 though axis 78, bracket 71 and mated apertures 72 and 73. Fins, such as fins 69 are provided on the other ends of rollers 68 as shown in FIG. 6. In another embodiment, adjustment means are provided by buoyant pontoon 87, preferably having keel assembly 88 attached thereto for stabilization. Such a pontoon assembly would be utilized in rougher, rolling, or turbulent water due to its effective resistance to the water's turbulence. As shown in FIG. 7, pontoon 87 is attached through brackets 83 and 84 to scoop 80 through apertures 85 and 86 in alignment with slots 81 and 82. The shape of the pontoon is appropriately shown in FIG. 8 in which pontoon 87 utilizes keel 88 for additional stabilization in the water.

Figure 9:
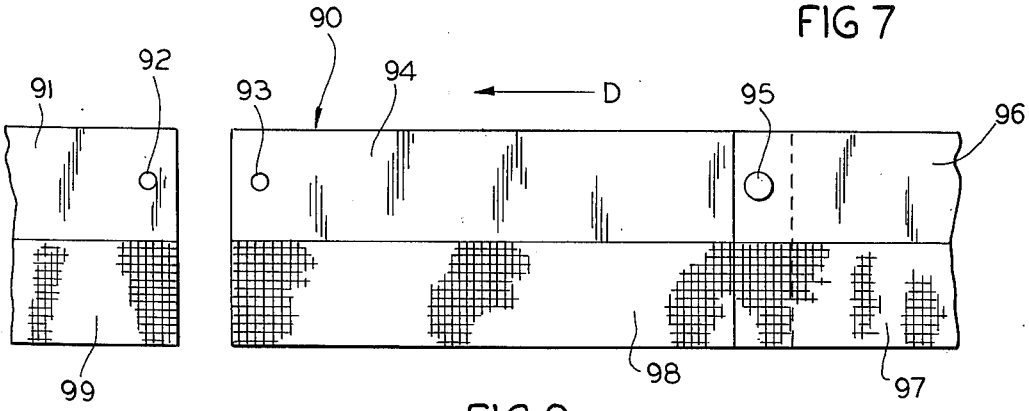
FIG. 9 is a side elevational view of the plurality of channeling apron segements making up the overall apron channeling means.

The plurality of apron channeling segments 91, 94 and 96 are shown in FIG. 9 capable of being pivotably attached at points 92 and 93 and actually attached at 95 for effective pivoting between the segments. Apron channeling means 90, through such a construction, has the capability to closely adhere to its containing position about the contaminant material on the surface of the body of water even though the body of water may differ greatly in depth and turbulence over a sizable area. Also shown in FIG. 9 are screen members 97, 98 and 99, utilized to maintain apron channeling means 90 in an upright position and to stabilize its movement through the body of water when such movement is activated by system activation means.

Figure 11:
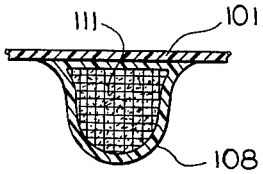
FIG. 11 is a cross-sectional view of the buoy means of FIG. 10.
Figure 10:
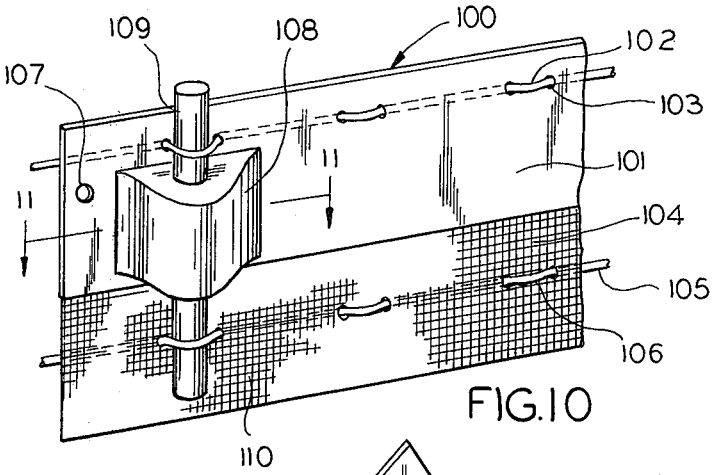
FIG. 10 is a side perspective view of the apron channeling means and buoy means.
Figure 12:
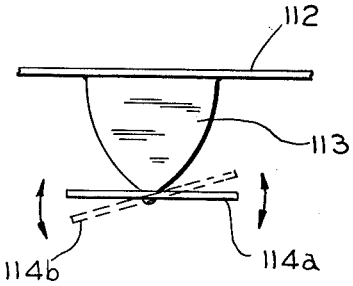
FIG. 12 is a top plan view of a buoyant member having adjustable rudder means.
Figure 13:
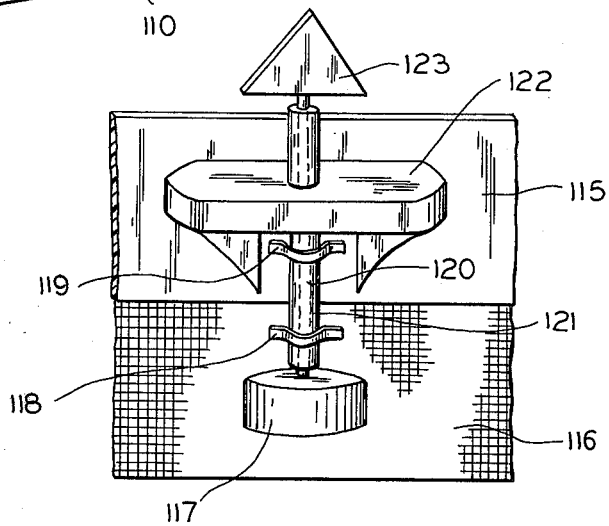
FIG. 13 is a top perspective view of a buoyant member having sail, keel, and adjustable rudder means.

Several embodiments of the buoy means are shown in FIGS. 10 through 13. In FIGS. 10 and 11, for example, arcuately-shaped buoy member 108, having member 109, is affixedly attached to apron channeling means 100 through buoy attachment means 102 and 105, here comprising a securing cable. As shown in this preferred embodiment, a portion of each buoy member is fixedly attached to the upper impervious portion 101 and lower screen portion 104 of apron channeling means 100. The lower screen portion 104 includes a screen member 110. As best seen in FIG. 11, the buoy member 108 has outer skin layer and an internal buoyant material 111 filling the inside thereof. Additional buoy features contemplated by the scope of the invention include the adjustable rudder 114 affixed to buoyant member 113, as shown by FIG. 12. The buoyant member 113 is fixed to the upper impervious portion 112 of the apron channeling means. Additionally, sail means 123 rotatably attached to buoyant member 122, having keels fabricated therein, and adjustable rudder means 117 attached to rotatable member 120 within sleeve 121, as shown in FIG. 13, may be utilized to effectuate the desired directional deployment of apron channeling means 115 in the system. The preferred attachment of the sleeve 121 is by means of a bracket 118 secured to screen member 116 and by a bracket 119 to the apron channeling member 115.

Figure 14:
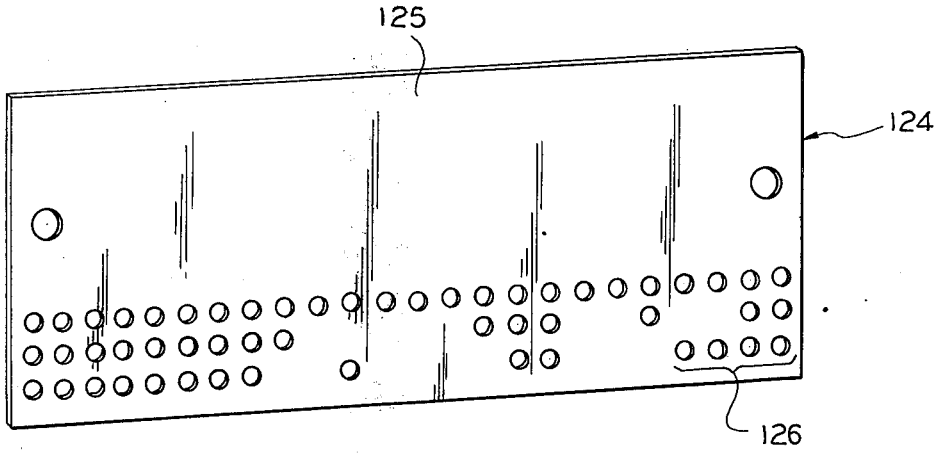
FIG. 14 is a side perspective view of a one-piece integrated apron channeling means.

Integral apron member 124 is shown in FIG. 14 having an impervious upper portion 125 surrounding the periphery of the contaminant and the penetrable lower portion having apertures, such as apertures 126, for maintaining the apron channeling means 124 in an upright position while stabilizing the apron channeling means when movement is initiated by system activation means.

Figure 15:
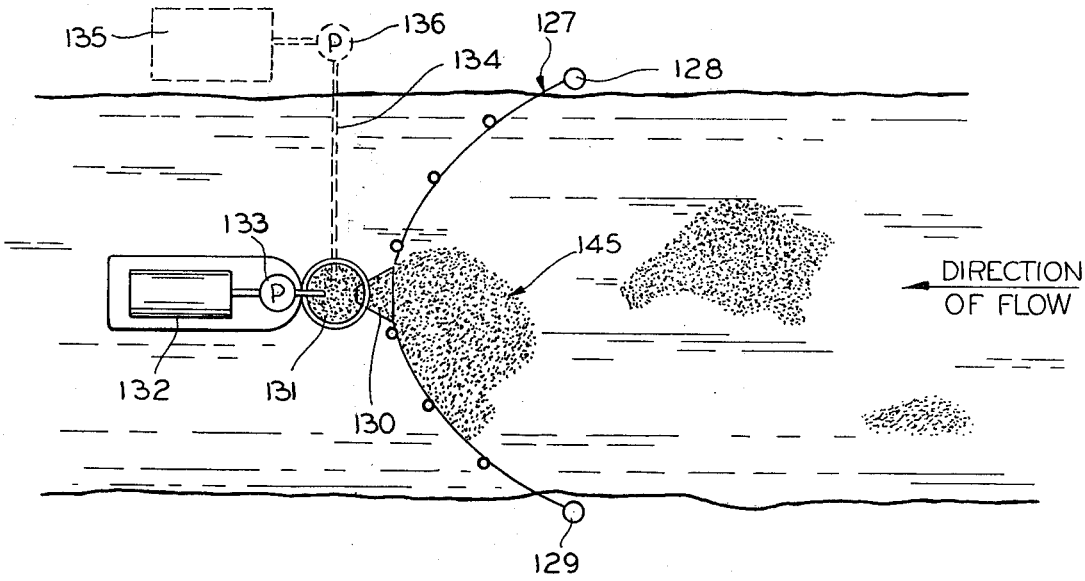
FIG. 15 is a top plan schematic view of the system activation means relying on natural flow of the body of water.

A second embodiment of the system activation means is shown in FIG. 15 in which the contaminant recovery system having an apron channeling means 127 is restrainably positioned transverse to a flowing body of water, such as by attachment to opposing river banks, at 128 and 129. In such an embodiment, the flow of the body of water itself assists in the channeling or funneling of contaminant 145 into scoop 130 and collection means 131. Material transport means 133 directs contaminant material to storage means 132 in the form of a boat in the same body of water, or equivalent material transport means 134 may be utilized to transfer the contaminant material to storage means 135 located on dry land through pump 136.

Figure 16:
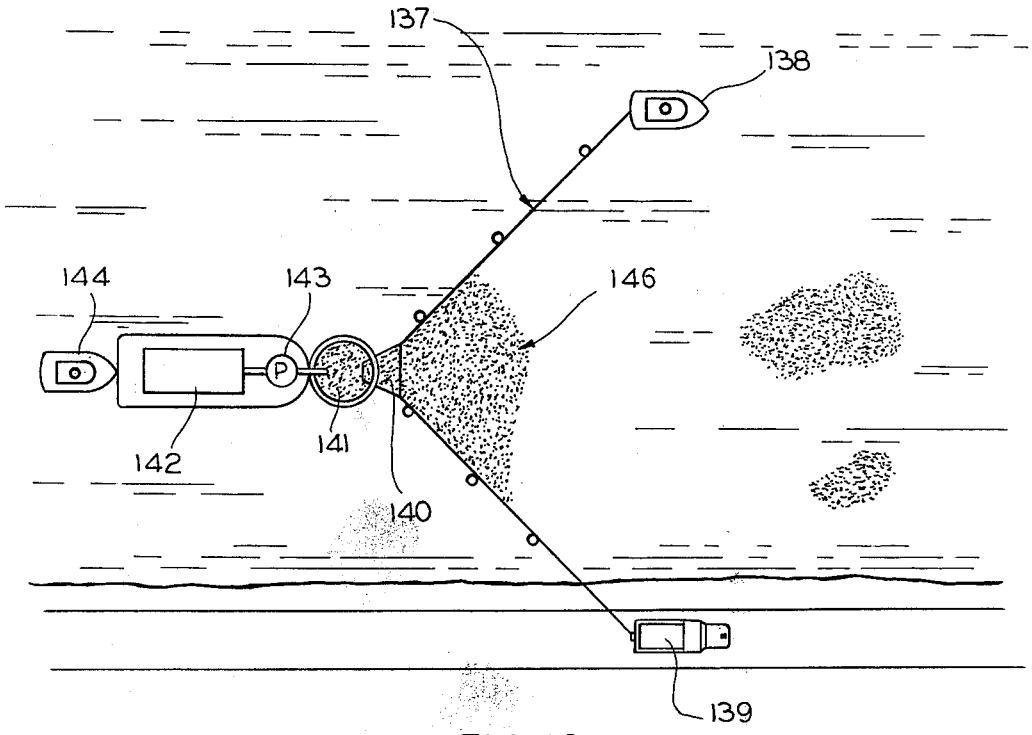
FIG. 16 is a top plan schematic view of an alternative system activation means in which the system is towed by water towing means both in and out of the body of water.

Additionally, a variation in towing means may be utilized in which water towing means 138 and 139 may be utilized to tow apron channeling means 137, scoop 140, and collection means 141 by land and water towing through the body of water to collect contaminant 146 into scoop 140. Collection means 141 and subsequently material transport means 143 then direct the contaminant into reservoir 142. As shown in FIG. 16, the permanent storage means 142 operably attached to the collection means 141 and scoop 140, is directed in the same direction of towing as the rest of the system and at the same speed by towing means 144.

The foregoing description and drawings merely explain and illustrate the invention and the invention is not limited thereto, except insofar as the intended claims are so limited, as those skilled in the art who have the disclosure before them will be able to make modifications and variations therein without departing from the scope of the invention.

What is claimed is:

1. A method for removing petroleum and other spilled contaminant material from the surface of body of water, while at the same time recovering said petroleum or other contaminant in its original form for reuse or reprocessing, said method comprising:

a. positioning substantially impervious open-ended main barricade means about the periphery of said contaminant material;

b. channeling said contaminant towards one or more contaminant collection areas;

c. skimming both said body of water and said contaminant material at said one or more collection means at a desired depth by scoop means; rotating a roller means at the scoop means to aid in positioning the scoop means and in inducing flow through said scoop means;

d. separating said contaminant material from said water so as to isolate said contaminant material, and e. directing said isolated contaminant material to contaminant retention means through which said contaminant material may be contained for said reuse and reprocessing.

2. The method according to claim 1 in which said positioning of said substantially impervious main barricade means about the periphery of said contaminant material is accomplished through independently maneuvering said outermost open ends of said barricade means about the periphery of said contaminant material by barricade deployments means;

said maneuvering substantially forming said barricade means into contaminant funneling means converging at said one or more collection means.

3. The method according to claim 2 in which said positioning of said substantially impervious main barricade means about the periphery of said contaminant material further includes preliminarily funneling said contaminant material into said barricade means through the use of preliminary barricade and preliminary barricade deployment means thereby minimizing the deployment efforts required with the maneuvering of said impervious barricade means.

4. The method according to claim 1 in which said channeling of said contaminant material toward said one or more collection areas is accomplished through moving said main barricade means and said collection means about and towards said periphery of contaminant material so as to thereby funnel said contaminant material towards and into said one or more collection means.

5. The method accordig to claim 1 in which said channeling of said contaminant material toward said one or more collection areas is accomplished by restrainably positioning said barricade means and said collection means transverse to the natural flow of said body of water, thereby converging said contaminant material towards and into said one or more collection areas without the need for imparting movement to said barricade and collection means.

6. A system for removing and recovering contaminant material from the surface of a body of water comprising:

open-ended apron channeling means maintained afloat in said body of water by apron buoys, said apron channeling means restrainably attached to collection means so as to converge thereto, said apron channeling means being impervious to said contaminant material;

said collection means including scoop means for skimming said contaminant material from the surface of said body of water as said contaminant material is directed to said collection means by said apron channeling means;

material transport means operably attached to said collection means for removing said contaminant material from said collection means; and system activation means for initiating movement between said system and said body of water to channel said contaminant material to said collection means and to activate said skimming, said scoop means including a rotatable roller means having fins thereon for inducing rotation of said roller means when the body of water has relative movement to said scoop means to aid in positioning said scoop means relative to said apron channeling means and to induce flow of water and contaminant material into said scoop means.

7. The system according to claim 6 in which said apron channeling means comprises:

an impenetrable upper apron member extending from below the bottom surface of said contaminant material riding on the surface of said body of water to a position substantially above the upper surface of said contaminant material; and a penetrable lower screen member extending downwardly from said upper apron member from a position beneath the lower surface of said contaminant material riding on the surface of said body of water, for maintaining said apron channeling means in a generally upright position in said body of water while stabilizing the movement of said apron channeling through said body of water.

8. The system according to claim 6 in which said apron channeling means comprises:

an integral apron member of plastic material which is impenetrable along an upper portion extending from below the bottom surface of said contaminant material to substantially above the upper surface of said contaminant material;

said integral apron member having a lower surface which is penetrable along a lower portion extending downwardly from below the bottom surface of said contaminant material riding on said body of water.

9. The system according to claim 6 in which said apron buoys comprise:

a plurality of buoyant members each of which is attached to said apron channeling means along the outside periphery of said apron channeling means, each of said buoys being arcuately shaped so as to minimize drag in said body of water and restrainably attached to said apron channeling means in juxtaposed fashion by buoy attachment means.

10. The system according to claim 9 in which each of said members includes rudder means for controlling the deployment of said apron channeling means about said contaminant material in said body of water.

11. The system according to claim 9 in which one or more of said plurality of buoyant members further comprise:

keel means on the bottom surface of said buoyant member;

said means for facilitated movement of said buoyant members and, in turn, the channeling apron attached thereto; and adjustable rudder means for controlling the direction of movement of said buoyant members and, in turn, said apron channeling means in said body of water.

12. The system according to claim 6 in which said scoop means for skimming said contaminant material from the surface of said body of water comprises:

a substantially trapezoidal-shaped scoop member with flanged sides pivotally attached to said collection means at the front of said collection means;

the face of said scoop member closely juxtaposed to the converging ends of said apron channeling means.

13. The system according to claim 12 in which said scoop means further includes means for adjustment comprising:

a substantially buoyant scoop roller means positioned beneath said scoop member, said scoop roller means being adjustable in a longitudinal direction beneath said scoop member thereby enabling variations in skimming angle and depth immersion of said scoop member relative to the longitudinal position of said scoop roller means below said scoop member.

14. The system according to claim 12 in which said scoop means further includes means for adjustment comprising:

a substantially buoyant scoop pontoon means positioned beneath said scoop member.

said scoop pontoon means being adjustable in a longitudinal direction beneath said scoop member thereby enabling variations in skimming angle and depth immersion of said scoop member relative to the longitudinal position of said scoop roller means below said scoop member.

15. The system according to claim 6 in which said apron channeling means comprises:

a plurality of apron channeling segments pivotally attached to one another respectively so as thereby to facilitate the surface positioning of said apron channeling means relative to a turbulent and rolling body of water.

16. The system according to claim 6 in which said system activation means comprises:

water towing means positioned at the open ends of said apron channeling means, said system activation means imparting flow of said body of water relative to said collection means while said apron channeling means is directed into and about said contaminant material to channel said contaminant material towards and into said collection means.

17. The system according to claim 6 in which said system activation means comprises:

natural flow movement of the body of water itself, said system being restrainably positioned relative to said body of water with said natural flow channeling and directing said contaminant material into said collection means.

18. The system according to claim 6 in which said system activation means comprises:

integrated propellant means capable of pushing said system through said body of water so as to create flow between said system and said body of water, thereby directing said contaminant material toward and into said collection means.

19. A system for removing and recovering contaminant material from the surface of a body of water comprising:

open-ended apron channeling means maintained afloat in said body of water by apron buoys, said apron channeling means restrainably attached to collection means so as to converge thereto, said apron channeling means being impervious to said contaminant material;

said apron channeling means having a plurality of buoyant means attached to portions of said apron channeling means, said buoyant means including a body portion attached to apron channeling means and an upper sail means extending upwardly from and supported by said body portion for receiving wind thereagainst, a lower adjustable means on said buoyant means being turnable relative to said body portion to control the direction of movement of said apron channeling means in said body of water, said collection means including scoop means for skimming said contaminant material from the surface of said body of water as said contaminant material is directed to said collection means by said apron channeling means;

material transport means operably attached to said collection means for removing said contaminant material from said collection means; and system activation means for initiating movement between said system and said body of water to channel said contaminant material to said collection means and to activate said skimming.

* * * * *